United States Patent [19]

Wu

[11] Patent Number: 4,936,332

[45] Date of Patent: Jun. 26, 1990

[54] SIMPLY-CONSTRUCTED AUTOMATIC UMBRELLA FOR PREVENTING FALSE OPERATION

[76] Inventor: Tsun-Zong Wu, No. 16, Chen Tai Rd., Sec. 3, Wu-Ku Hsiang, Taipei Hsien, Taiwan, 24801

[21] Appl. No.: 425,462

[22] Filed: Oct. 23, 1989

[51] Int. Cl.[5] ..... A45B 25/16

[52] U.S. Cl. ..... 135/20 M; 135/24; 135/29

[58] Field of Search ..... 135/22, 24, 20 M, 28, 135/31, 29

[56] References Cited

U.S. PATENT DOCUMENTS

| | | | |
|---|---|---|---|
| 3,658,076 | 4/1972 | Yasuda | 135/22 |
| 3,756,258 | 9/1973 | Yoshihara | 135/22 |
| 4,421,133 | 12/1983 | Huang | 135/22 |
| 4,535,374 | 8/1985 | Day | 135/22 |
| 4,823,821 | 4/1989 | Day | 135/22 X |
| 4,825,888 | 5/1989 | Su | 135/22 |

*Primary Examiner*—David A. Scherbel
*Assistant Examiner*—Lan Mai

[57] ABSTRACT

An automatic umbrella includes: a central shaft having an upper shaft telescopically mounted on a lower shaft, a rib assembly having at least a top rib and a stretcher rib supporting the top rib, an elongate extending spring inserted inside the central shaft which may be lightly operated for resetting the umbrella for restoring its elastic force for extending the shafts, the ribs and the umbrella, a plurality of restoring springs each secured in said rib assembly for normally urging and retracting the ribs, and a seesaw button seesawly formed in a grip of the shaft for selectively extending the shaft, the ribs for opening the umbrella, or for retracting the ribs for closing the umbrella. The umbrella also includes a drag rod formed in the shafts having a locking head formed on a lower end of the rod to be locked by a retraction controller for preventing a false closing operation when opening the umbrella.

4 Claims, 2 Drawing Sheets

SIMPLY-CONSTRUCTED AUTOMATIC UMBRELLA FOR PREVENTING FALSE OPERATION

BACKGROUND OF THE INVENTION

A conventional automatically opening and closing umbrella, such as taught by U.S. Pat. No. 4,421,133 by Yueh Huang, U.S. Pat. No. 4,535,374 and 4,823,821 by San-Tong Day and U.S. Pat. No. 4,825,888 by Tseng Su, disclosed a short spring for opening the umbrella which is retained within an intermediate tubular shaft between an upper tubular shaft and a lower tubular shaft. Since the spring for opening the umbrella is so short between the upper and lower shafts, the spring must be made of larger or coarse steel wire to develop enough elastic force so that it requires a big force for depressing the umbrella grip for restoring the elastic force of the spring after being released, easily causing tiredness of an umbrella user or possibly causing loss of a user's interest.

Meanwhile, it is easy to falsely operate the conventional automatic umbrella, for instance, in depressing the push button 6 of Day's U.S. Pat. No. 4,823,821, a suddenly continuous depression of the button 6 or uncareful push button operation, the umbrella frame and cloth may be first opened and then closed quickly. A false operation may be done for such conventional automatic umbrella.

Furthermore, the conventional automatic opening and closing umbrella has a complex structure or mechanism, thereby increasing its production cost and maintenance problems.

The present inventor has found the drawbacks of the conventional automatic opening and closing umbrellas and invented the present simply-constructed umbrella for preventing false operation.

SUMMARY OF THE INVENTION

The object of the present invention is to provide an automatic umbrella having an elongate extending spring stored within the hollow portions in all telescopic tubular shafts of the umbrella central shaft for a lighter depression work for saving a user's energy when restoring or resetting the extending spring ready for its next extending operation.

Another object of the present invention is to provide a control mechanism for preventing a false push button operation, such as for preventing an unwanted suddenly collapsing after opening an umbrella.

Still another object of the present invention is to provide a control means having a retraction controller of a drag rod axially actuated in the central shaft for simpler construction and minor maintenance problem.

DETAILED DESCRIPTION

Figure 1:
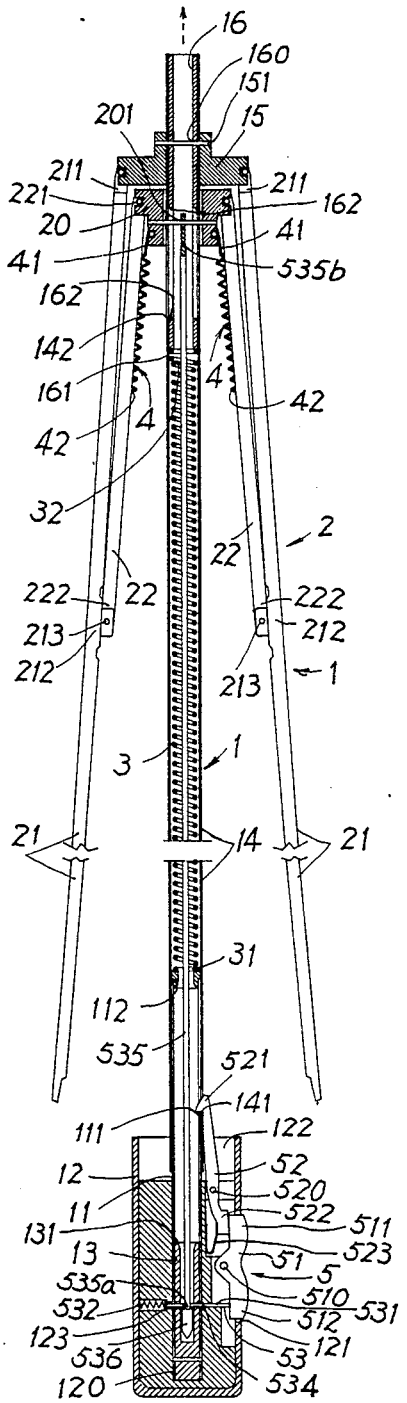
FIG. 1 is an illustration of the present invention when folded.
Figure 3:
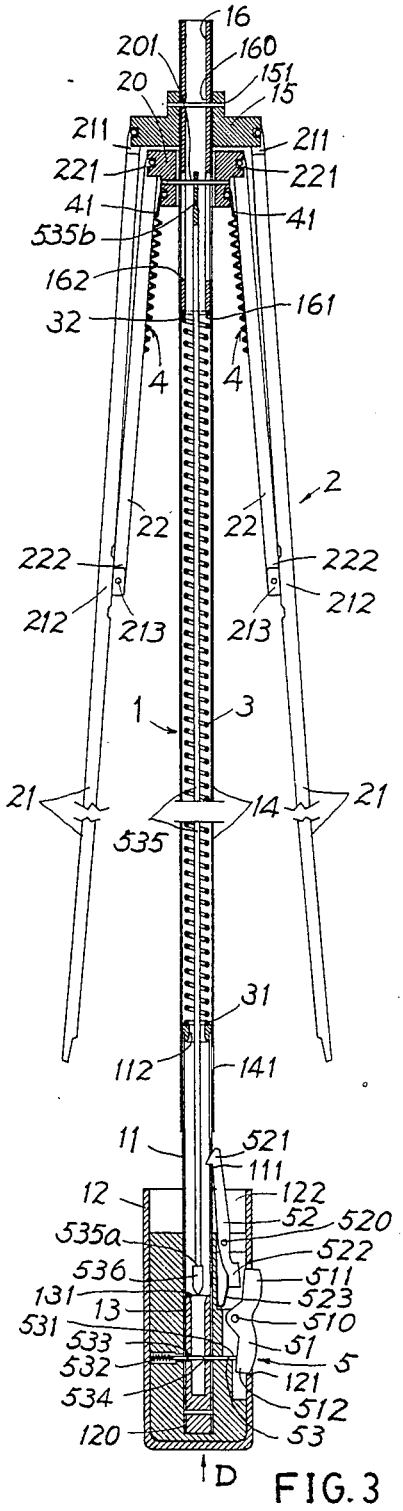
FIG. 3 shows a collapsing umbrella of the present invention when retracting the umbrella as shown in FIG. 2.
Figures 1A, 2:
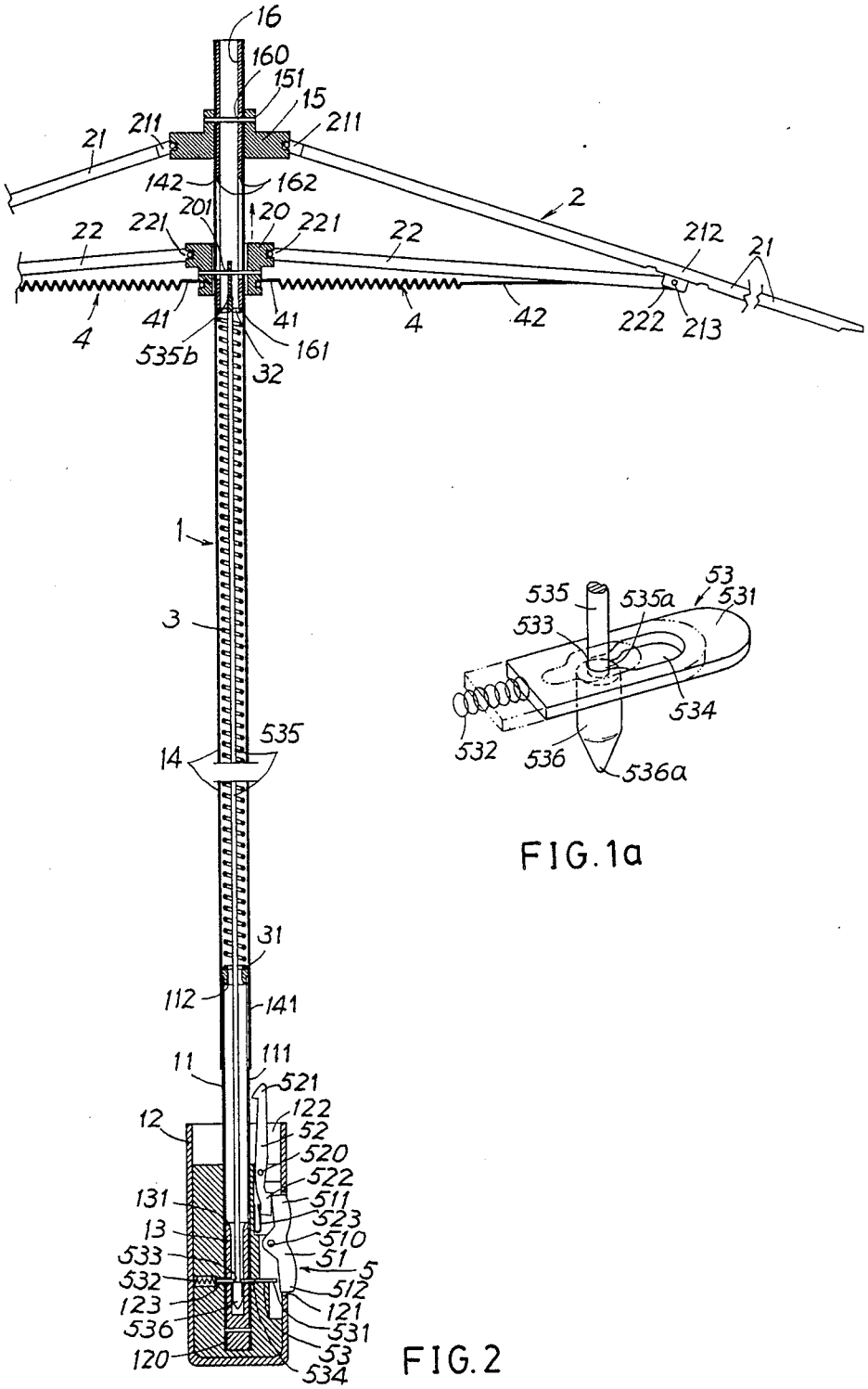
FIG. 1*a* shows a partial control means of the present invention.
FIG. 2 shows an extending umbrella in accordance with the present invention.

As shown in FIGS. 1–3, the present invention comprises: a central shaft means 1, a rib assembly 2 for securing an umbrella cloth thereon, an extending spring 3 for opening the umbrella, at least a retraction restoring means 4 for closing the umbrella, and a control means 5 for the control of opening or closing operation of the umbrella.

The central shaft means 1 includes: a lower tubular shaft 11, a grip 12, a lower sleeve 13 fixed in a lower portion of the lower shaft 11, an upper tubular shaft 14 telescopically mounted on the lower shaft 11, an upper notch 15 formed on a top portion of the upper shaft 14 and an upper sleeve 16 fixed in an upper portion of the upper shaft 14 and secured to the notch 15.

The lower tubular shaft 11 has its lower portion inserted in a central shaft hole 120 in the grip 12, having a hook hole 111 formed in the shaft 11. The lower sleeve 13 includes an upper taper opening 131 for smoothly guiding a locking head 536 of the retraction controller 53 of the control means 5 into the lower sleeve 13.

The upper tubular shaft 14 is formed with a hook hole 141 in a lower portion of the shaft 14 communicated with the hook hole 111 when shortening the shafts 1 and folding the umbrella as shown in FIG. 1. The connection between the upper shaft 14 and the lower shaft 11 is a conventional mechanism for preventing their separation.

The rib assembly 2 is conventional as found in a conventional umbrella and may include: a top rib 21 having an inner end portion 211 of the rib 21 pivotally secured to the notch 15, and a stretcher rib 22 having an inner end portion 221 of the rib 22 pivotally secured to a runner 20 slidably encompassed on the upper tubular shaft 14 and having an outer portion 222 of the rib 22 pivotally secured with a middle portion 212 of the first rib 21 by a pivot 213.

Naturally, the present invention may also be used in a multiple-fold umbrella having a plurality of ribs in construction of a rib assembly 2 of the umbrella.

The extending spring 3 is an elongate coil spring having a diameter of each spring ring generally equal to an inside diameter of the upper shaft 14 having its lower end 31 retained on a plug 112 fixed on a top portion of the lower shaft 11 and having its upper end 32 retained against a bottom portion 161 of the upper sleeve 16 secured in the upper shaft 14.

The retraction restoring means 4 may be a restoring coil spring having its inner end 41 secured to the runner 20 and having its outer end 42 secured to an outer end portion or a middle portion of the stretcher rib 22. The spring 4 is normally urging the rib assembly 2 towards a collapsed state, such as for normally urging the runner 20 upwardly to retract the stretcher rib 22 and top rib 21 inwardly as shown in FIG. 3 so as to close the umbrella. The elastic force of the spring 4, when compressed by extending the rib assembly 2 when opening the umbrella as shown in FIG. 2, should always be smaller than the elastic force of the extending spring means 3 under compression when the umbrella is closed and the tubular shafts are shortened to accumulate the elastic force of the spring 3 as shown in FIG. 1, or when released as the umbrella is opened as shown in FIG. 2. The coil spring of the retraction restoring means 4 may also be secured to any other locations of the rib assembly 2 which is not limited in this invention.

The retraction restoring means 4 of the present invention may also be a restoring coil spring having an inner spring end 41 secured to the upper notch 15 and having an outer spring end 42 secured to a joint 213 pivotally connecting an outer portion 222 of a stretcher rib 22 and a middle portion of a top rib 21 of the rib assembly 2, or having an outer spring end 42 secured to a middle portion of the top rib 22.

The control means 5 includes: a seesaw button 51, an extension controller 52 for controlling the extension of upper shaft 14 and the opening of the umbrella, and a retraction controller 53 for the control of the retraction of the rib assembly 2 and the closing of the umbrella.

The seesaw button 51 is pivotally mounted by a pin 510 in a button hole 121 formed in a side portion of the grip 12, having an upper lever 511 operatively depressing the extension controller 52 and a lower lever 512 operatively depressing the retraction controller 53.

The extension controller 52 generally formed as a biasing lever has its middle portion pivotally secured in a socket 122 in the grip 12 above the button 51 by a pin 520, its upper portion formed as a hook portion 521 engageable with the hook holes 141, 111 formed in the central shaft means 1, and its lower portion formed as a depression block 522 resiliently retained by an upper tensioning spring 523 secured in the grip 12 and operatively depressed by the upper lever 511 of the seesaw button 51. The tensioning spring 523 normally urges the lower depressing block 522 outwardly to bias the upper hook portion 521 inwardly to engage the hook holes 141, 111 formed in the shafts 14, 11.

The retraction controller 53 includes: a sliding latch 531 as shown in FIG. 1*a* transversely sliding in a lateral slot 123 formed in a lower portion of the grip 12 and resiliently held in the slot 123 by a lower tensioning spring 532 which urges the sliding latch 531 outwardly, having an inner latch hole 533 for passing therethrough a drag rod 535 and an outer latch hole 534 adjacent to the hole 533 larger than the inner hole 533 for passing a locking head 536 formed on a lower end portion 535*a* of the rod 535 through the outer hole 534; and the drag rod 535 slidably held in the shaft means 1 having the lower locking head 536 having a diameter larger than that of the rod 535 with a taper portion 536*a* formed on its lowest end portion, and having an upper end portion 535*b* secured with the runner 20 by a runner pin 201.

The upper sleeve 16 inserted in the upper shaft 14 has an upper sleeve portion 160 secured with the upper notch 15 by a notch pin 151. A pair of longitudinal slots 162, 142 are respectively longitudinally formed through two tubular walls of the upper sleeve 16 and upper shaft 14 for reciprocatively passing the pin 201 which transversely secures the upper end portion 535*b* of the drag rod 535 to the lower runner 20. The upper sleeve 16 fixed in the upper shaft 14 also serves as a reinforcing tube combined with the upper tubular shaft 14 to provide a suitable strength for the umbrella shaft means 1.

The drag rod 535 has a length generally equal to a length of a shortened or folded shaft means 1 as shown in FIG. 1 having its lower locking head 536 normally locked by the sliding latch 531 and having its upper end portion 535*b* secured with the runner 20 to be limited by the upper end of each slot 162 or 142 formed in the upper sleeve 16 or the upper shaft 14. Each slot 142 or 162 has a length limiting an upward movement of the pin 201 when closing the umbrella as shown in FIG. 3 or limiting a downward movement of the pin 201 when opening the umbrella as shown in FIG. 2.

When it is intended to open the folded umbrella as shown in FIG. 1, the upper lever 511 is depressed inwardly to bias the extension controller 52 to release the hook portion 521 from the hook hole 141 of the upper shaft 14 so that the extending spring 3 having stored its elastic force when folding the shafts from the situation as shown in FIG. 3 to FIG. 1 will urge the upper sleeve 16 and the upper shaft 14 upwardly so as to extend the ribs 2 outwardly upwardly for opening the umbrella as shown in FIG. 2. The rod 535 having the locking head 536 locked by the latch 531 serves to counteract a retraction force urged by the restoring spring 4 for preventing a false closing of umbrella when extended as shown in FIG. 2. After releasing the elastic force of the spring 3 as shown in FIG. 2, the spring 3 may have an extended length almost equal to the length of the extended shaft means 1 except the upper sleeve 16 and the lower shaft 11. The extended spring 3 should still have an elastic force acting upon the upper sleeve 16 for ensuring a stable opening of the extended umbrella.

For closing the umbrella, the lower lever 512 is depressed inwardly to depress the latch 531 to allow the larger outer hole 534 to match the locking head 536 to unlock the locking head 536. Simultaneously, the restoring spring 4 normally urges the runner 20 upwardly to retract the rib assembly 2 towards the central shaft means 1 to pull the rod 535 upwardly until being limited by the upper ends of the slots 162, 142 since the rod 535 and locking head 536 is no longer locked by the latch 531, thereby closing the umbrella automatically as shown in FIG. 3. The runner 20 is thus upwardly moved to match the notch 15 as shown in FIG. 3. At this time, the spring 3 is still at released situation so that a resetting or restoring operation must be done by depressing the grip 12 in a direction D towards the upper notch 15 so as to shorten or fold the plural shafts to restore the spring 3 for accumulating its resilience energy or elastic force for next opening or extension operation (FIG. 3 to FIG. 1).

The present invention has the following advantages superior to a conventional automatic closing and opening umbrella:

1. The extending spring 3 when extended has a length almost occupying a full length of the extended lower shaft 11 and upper shaft 14 so that it can be depressed for resetting the spring 3 from FIG. 3 to FIG. 1 with a lighter force, as compared with a conventional automatic umbrella having a very short restoring spring in view of Hooke's law.

2. Even depressing the lower lever 512 of the seesaw button 51 of the umbrella as shown in FIG. 1, the upper extension controller 52 is not operated so that the umbrella will not be falsely opened. Reviewing the extended umbrella as shown in FIG. 2, even the restoring spring 4 always urges the runner 20 for retracting the ribs 2 in order to close the umbrella, the upward pulling of rod 535 for retracting the ribs 2 is locked by the latch 531 which locks the locking head 536 of the rod 535 connected with the runner 20, unless depressing the lower lever 512 of button 51. So, at this time if a false depression of the upper lever 511, the umbrella is not influenced, without being falsely closed.

Accordingly, this invention may prevent a false operation. It means that an opening or a closing operation can be clearly distinguished by depressing either an upper lever or a lower lever of a seesaw button of the invention.

3. The automatic opening and closing mechanism and structure of this invention is very simple so that a production cost thereof can be greatly reduced, and a service life of the umbrella can be prolonged.

The seesaw button 51 of the control means 5 may also be modified to include two buttons (not shown), an upper button for operatively depressing the extension controller 52, and a lower button for depressing the sliding latch 531 of the retraction controller 53.

I claim:

1. An automatic umbrella comprising:

a central shaft means including a lower tubular shaft, a grip fixed on a lower portion of said lower tubular shaft, a lower sleeve inserted in said lower shaft, an upper tubular shaft telescopically mounted on said lower tubular shaft, an upper notch formed on an upper portion of said upper shaft and an upper sleeve fixed in an upper portion of said upper shaft and secured to said upper notch;

a rib assembly for securing an umbrella cloth thereon including at least a top rib having an inner end portion of said top rib pivotally secured to said upper notch and a stretcher rib pivotally secured to at least one said top rib having an inner end portion of said stretcher rib pivotally secured to a runner slidably encompassed on said upper shaft;

an extending spring formed as an elongate coil spring retained in said central shaft means having a lower end of said extending spring retained on an upper end portion of said lower shaft and having an upper end of said extending spring retained on a bottom portion of said upper sleeve;

at least a retraction restoring means secured in said rib assembly normally urging said rib assembly inwardly towards said central shaft means for closing the umbrella; and a control means formed in said grip selectively actuating an extension controller formed in an upper portion of said grip for extending said shaft means and said rib assembly for opening the umbrella, or actuating a retraction controller generally formed in a lower portion of said grip and inside said shaft means for closing the umbrella;

the improvement which comprises:

said extension controller generally formed as a biasing lever pivotally secured in a socket formed in said grip, a hook portion formed on an upper portion of said extension controller engageable with a hook hole formed in a lower portion of said upper shaft, and a depression block formed on a lower portion of said extension controller resiliently protruding outwardly by a tensioning spring in said grip to be depressible by said control means for biasing said hook portion inwardly to engage said hook hole in said upper shaft for locking said upper shaft for folding the shaft means and the umbrella; and said retraction controller including a sliding latch resiliently formed in a lower portion of said grip to be operatively depressed by said control means, and a drag rod slidably axially held inside said shaft means having a locking head formed on a lower end portion of said drag rod normally locked by said sliding latch, and having an upper end portion of said rod secured to said runner by a runner pin transversely fixed in said runner, said runner pin reciprocatively moving in a pair of longitudinal slots respectively formed in said upper shaft and said upper sleeve, said rod with the locking head locked by said sliding latch counteracting a retraction force urged by said retraction restoring means for preventing a false closing operation of the umbrella when the rib assembly and shaft means are extended to open the umbrella.

2. An automatic Umbrella according to claim 1, wherein said hook portion of said extension controller is engageable with a second hook hole formed in said lower shaft.

3. An automatic umbrella according to claim 1, wherein said drag rod of said retraction controller has a length generally equal to a length of said shaft means as folded, having the lower locking head normally locked by the sliding latch and having an upper end portion of said rod secured with said runner by said runner pin reciprocatively limited in said slots formed in said upper shaft and upper sleeve.

4. An automatic Umbrella according to claim 1, wherein said sliding latch of said retraction controller is resiliently held in a lateral slot formed in a lower portion of said grip by a lower tensioning spring which urges said sliding latch outwardly to be depressed by said control means, said latch having an inner latch hole for passing said rod and locking said locking head of said rod and an outer latch hole adjacent to and larger than said inner hole for passing said locking head when depressing said latch inwardly.

* * * * *